US006992631B2

(12) United States Patent
Lu

(10) Patent No.: US 6,992,631 B2
(45) Date of Patent: Jan. 31, 2006

(54) DUAL-BAND ANTENNA

(75) Inventor: Yihua Lu, Taipei Hsien (TW)

(73) Assignee: Micro-Star Int'l Co., Ltd., Taipei Hsien (TW)

( * ) Notice: Subject to any disclaimer, the term of this patent is extended or adjusted under 35 U.S.C. 154(b) by 0 days.

(21) Appl. No.: 10/710,929

(22) Filed: Aug. 13, 2004

(65) Prior Publication Data

US 2005/0156783 A1 Jul. 21, 2005

(30) Foreign Application Priority Data

Jan. 20, 2004 (TW) ..... 93101620 A

(51) Int. Cl.
*H01Q 1/38* (2006.01)

(52) U.S. Cl. ..... 343/700 MS; 343/846

(58) Field of Classification Search ..... 343/700 MS, 343/848, 792.5, 795, 829, 846
See application file for complete search history.

(56) References Cited

U.S. PATENT DOCUMENTS 4,291,311 A * 9/1981 Kaloi ..... 343/700 MS
4,291,312 A * 9/1981 Kaloi ..... 343/700 MS
4,356,492 A * 10/1982 Kaloi ..... 343/700 MS
5,712,643 A * 1/1998 Skladany ..... 343/700 MS
5,771,025 A * 6/1998 Reece et al. ..... 343/828
5,828,340 A * 10/1998 Johnson ..... 343/700 MS
6,008,774 A * 12/1999 Wu ..... 343/828
6,157,344 A * 12/2000 Bateman et al. ..... 343/700 MS
6,343,208 B1 * 1/2002 Ying ..... 455/575.7
6,549,170 B1 * 4/2003 Kuo et al. ..... 343/702
6,624,790 B1 * 9/2003 Wong et al. ..... 343/702
6,747,600 B2 * 6/2004 Wong et al. ..... 343/700 MS
6,867,736 B2 * 3/2005 Faraone et al. ..... 343/700 MS
2003/0210187 A1 * 11/2003 Wong et al. ..... 343/700 MS
2004/0100409 A1 * 5/2004 Okado ..... 343/700 MS

* cited by examiner

*Primary Examiner*—Tuyet Vo
*Assistant Examiner*—Hung Tran Vy
(74) *Attorney, Agent, or Firm*—Winston Hsu

(57) ABSTRACT

The dual-band antenna of the present invention includes a substrate having a first edge, an emitting unit, a transmission line, and a ground pad. The emitting unit disposed on the first surface of the substrate has a first wire and a second wire, which are crossed at a feeding point. The transmission line coupled to the feeding point is used to transmit the RF signals. The ground pad disposed on the second surface of the substrate has a base and an extension. The base is extended from the substrate toward feeding point. The extension is adjacent to the emitting unit and is extended from the base toward the first edge. The combination of the base and the extension forms an "L" shape.

14 Claims, 23 Drawing Sheets

| Frequency (MHz) | 2400 | 2450 | 2500 | 5150 | 5250 | 5350 | 5750 | 5850 |
|---|---|---|---|---|---|---|---|---|
| Gain(dbi) H-Plane | -0.01 | 1.34 | 0.67 | 1.3 | 1.65 | 1.96 | 3.36 | 3.44 |
| Gain(dbi) E-Plan | 3.29 | 4.53 | 4.01 | 3.31 | 3.4 3 | 4.40 | 4.27 | 3.88 |

Fig. 7

DUAL-BAND ANTENNA

BACKGROUND OF INVENTION

1. Field of the Invention

The present invention relates to a dual-band antenna, and more particularly, to a dual-band antenna distributed on the printed circuit board.

2. Description of the Prior Art

As communication technology is increasingly improved, the weight, volume, cost, performance, and complexity of a communication system also become more important, so antennas that transmit and receive signals in a wireless communication system especially "draw designers" attention. In a wireless local area network (WLAN), because the space for setting up an antenna is limited and the antenna should transmit a large amount of data, the antenna should be carefully designed. The ordinary antennas used in a WLAN are flat printed antennas, which have the following characteristics: 1. a small volume, weight, and thickness due to being one single device; 2. low cost and simple to be manufactured by using a printed circuit; 3. easy adjustment of the resonant frequency, pattern, impedance, and polarization of the antenna by changing the structure and size and of the circuit. The flat printed antennas also have the following disadvantages: 1. low radiation efficiency and low gain; 2. narrow bandwidth (the bandwidth is about 5% of the center frequency). Because the signals of WLAN bands, 802.11b (2.4 GHz) and 802.11a(5.2 GHz), are easily influenced by surface features in the area. Since the printed antennas have the above disadvantages, how to improve the gain and bandwidth of the antenna at high frequency (5.2 GH) needs to be overcome by designers.

Please refer to the FIG. 1 and FIG. 2. Because WLANs operate in the bands 802.11b and 802.11a for receiving the dual bands by the antenna, a dual-band antenna 2 is disclosed by Taiwan patent 557603, which has a first horizontal wire 21, a second horizontal wire 22, and a vertical radiation wire 23 disposed on the top surface 26 of an interface substrate 24. A ground 28 is disposed on the bottom surface 26 of the interface substrate 24. The first horizontal wire 21 and the second horizontal wire 22 cooperate with the vertical radiation wire 23 to produce the high operation frequency and low operation frequency of the dual-band monopole antenna 2. A micro-strip 25 transmits the RF signals generated by the antenna. Therefore, when designers adjust the length or the width of the wire 21 or the wire 22 to change the behavior of one band of the antenna, the behavior of the other band will also be changed, making it difficult to design this kind of antenna.

SUMMARY OF INVENTION

Therefore, the purpose of the present invention is to provide a dual-band antenna, which has larger gain and bandwidth and is easier to design.

The dual-band antenna of the present invention includes a substrate, an emitting unit, a transmission line, and a ground pad. The emitting unit and the ground pad are on the opposite sides of the substrate. The transmission line coupled to the emitting unit is used to transmit the received or emitted RF signals.

The substrate has a first edge, and a first surface and a second surface that is on the opposite side of the substrate from the first surface. The emitting unit has a first wire and a second wire and is disposed on the first surface substantially between the first edge and a feeding point. The first wire and the second wire are crossed at the feeding point and the transmission line is coupled to the feeding point transmitting RF signals. The ground pad disposed on the second surface of the substrate includes a base and an extension. The base is extended from the substrate toward feeding point. The extension is adjacent to the emitting unit and extends from the base toward the first edge. The combination of the base and the extension forms an "L" shape.

These and other objectives of the present invention will no doubt become obvious to those of ordinary skill in the art after reading the following detailed description of the preferred embodiment that is illustrated in the various figures and drawings.

BRIEF DESCRIPTION OF DRAWINGS

FIG. 7 illustrates the measured gain in two bands of 2.4 GHz and 5.2 GHz in the preferred embodiment of the present invention.

DETAILED DESCRIPTION

The content, the characteristics, and the advantages of the present invention are clearly described in the following preferred embodiment and the figures.

Figure 1:
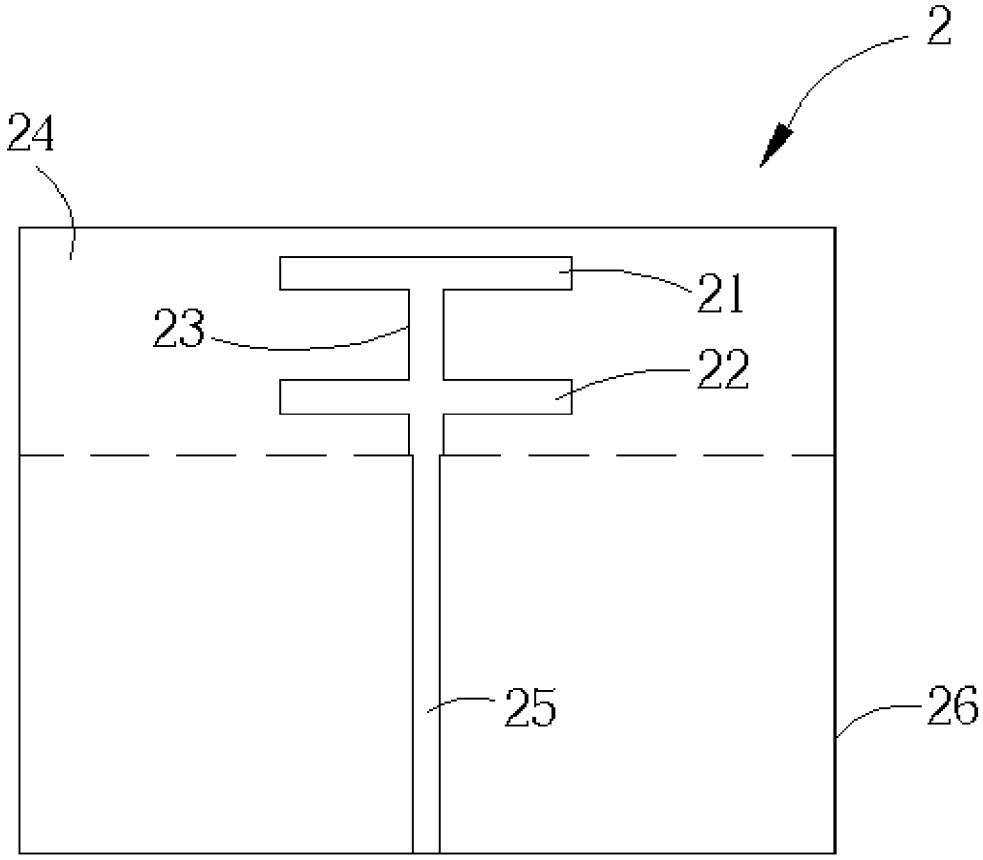
Fig. 1 Prior art
FIG. 1 illustrates a dual-band antenna of the prior art.
Figure 2:
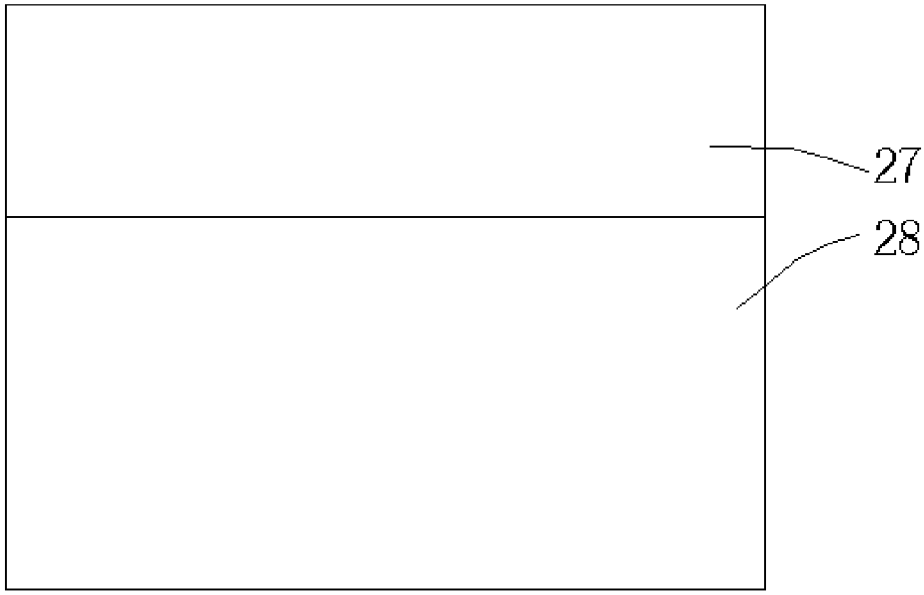
Fig. 2 Prior art
FIG. 2 illustrates the dual-band antenna in FIG. 1 in another view.
Figure 3:
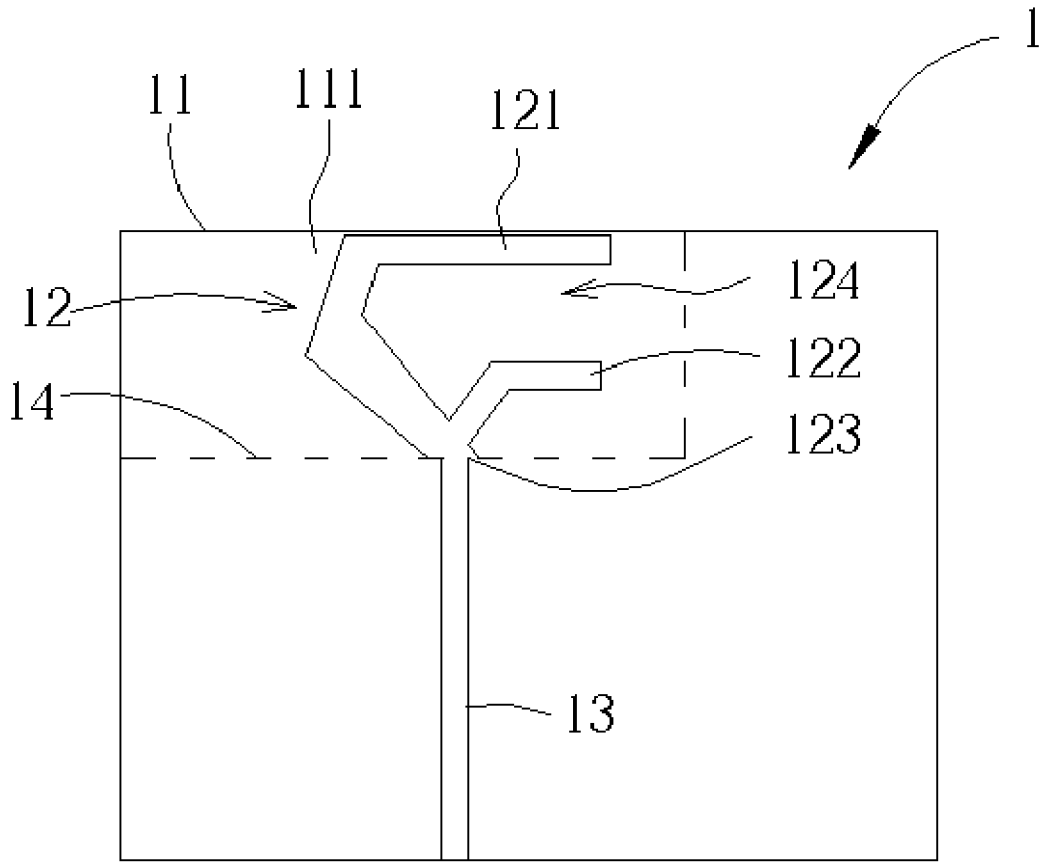
FIG. 3 illustrates the preferred embodiment of the present invention dual-band antenna.
Figure 4:
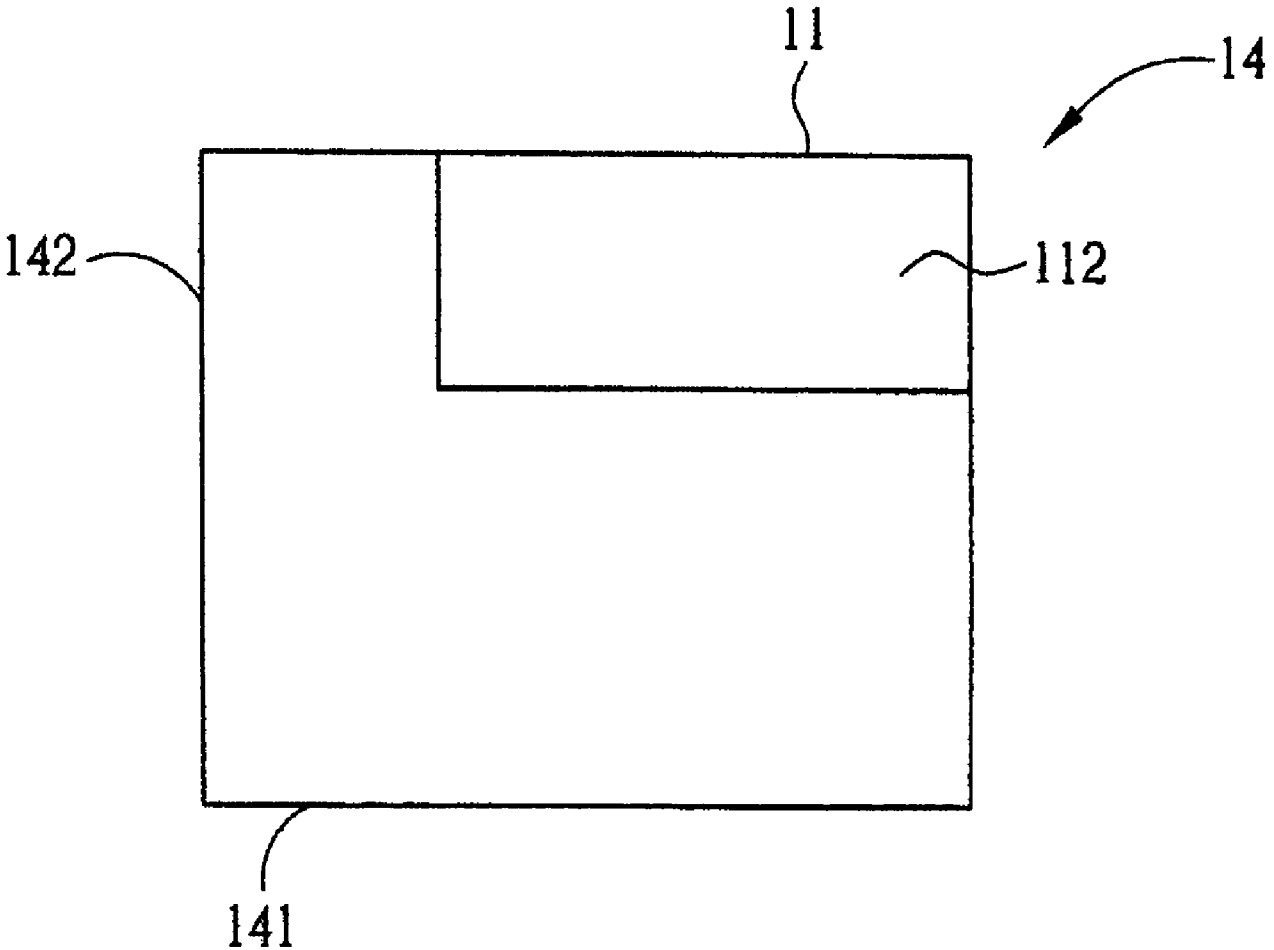
FIG. 4 illustrates the preferred embodiment of the present invention dual-band antenna from another view.

Please refer to FIG. 3 and FIG. 4. The dual-band antenna of the present invention comprises a substrate 11, an emitting unit 12, a transmission line 13, and a ground pad 14.

The emitting unit 12 and the ground pad 14 are on opposite sides of the substrate. The transmission line 13 coupled to the emitting unit is used to transfer the RF signals received or emitted by emitting unit 12. In the present invention, the transmission line 13 is a microstrip line. In other embodiment, it can be coaxial cable or a coplanar waveguide, and not to be limited by this disclosure.

The substrate 11 is a printed circuit board made of fiberglass reinforced epoxy resin and has a first surface 111 and a second surface 112 that is on the opposite side of the printed circuit board from the first surface 111. The printed circuit board also has a first edge shown at the top of FIG. 3. The emitting unit 12 and the transmission line 13 are printed on the first surface 111 of the substrate 11. The emitting unit 12 has a first wire 121 and a second wire 122. The first wire 121, the second wire 122, and the transmission line 13 are crossed at a feeding point 123 used to emit the RF signals from the transmission line 13 or receive the RF signals from the air. The first wire 121 and the second wire 122 are extended away from the feeding point 123 and bent at some angle, resulting in the emitting unit 12 being substantially between the feeding point 123 and the first edge of the substrate 11. The end portions of the wire 121 and the wire 122 are substantially parallel and form a mouth 124. The first wire 121 is longer than the second wire 122 and is used to decide the low operating frequency of the dual-band antenna 1. The second wire 122 is used to decide the high operating frequency of the dual-band antenna 1. Because the wire 121 and the wire 122 do not have a common part, designers can adjust two bands of the dual-band antenna 1 respectively without affecting each other. It is help for shortening the lag-time.

Transmission line 13 extending from the feeding point 123 to the downside of the substrate 11 is combined with the emitting unit 12 to form a similar "F" shape.

The ground pad 14 disposed on the second surface 112 of thee substrate 11 comprises a base 141 and an extension 142. The base 141 extends toward the feeding point 123 from the first edge of the substrate 11. The extension is adjacent to the emitting unit and extends from the base 141 toward the first edge of the substrate 11. The combination of the base and the extension makes an "L" shape, which generates electromagnetic coupling effects with the emitting unit 12 on the first surface 111 so that the first wire 121 and the second wire 122 can shorten the length corresponding to the operation frequency (one fourth wavelength of the electromagnetic signal, $\lambda/4$) as well as improve gain and bandwidth.

Figure 5:
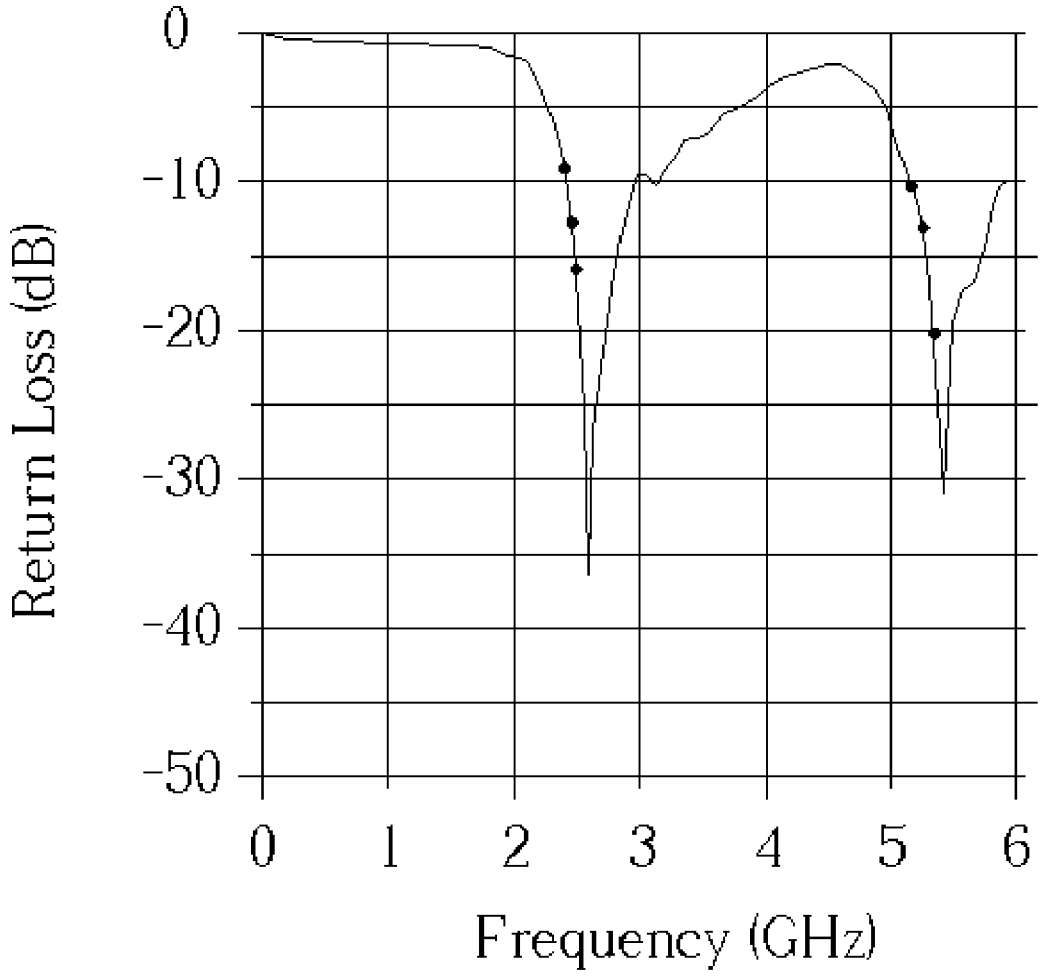
FIG. 5 illustrates the measured return loss in the preferred embodiment of the present invention.
Figure 6:
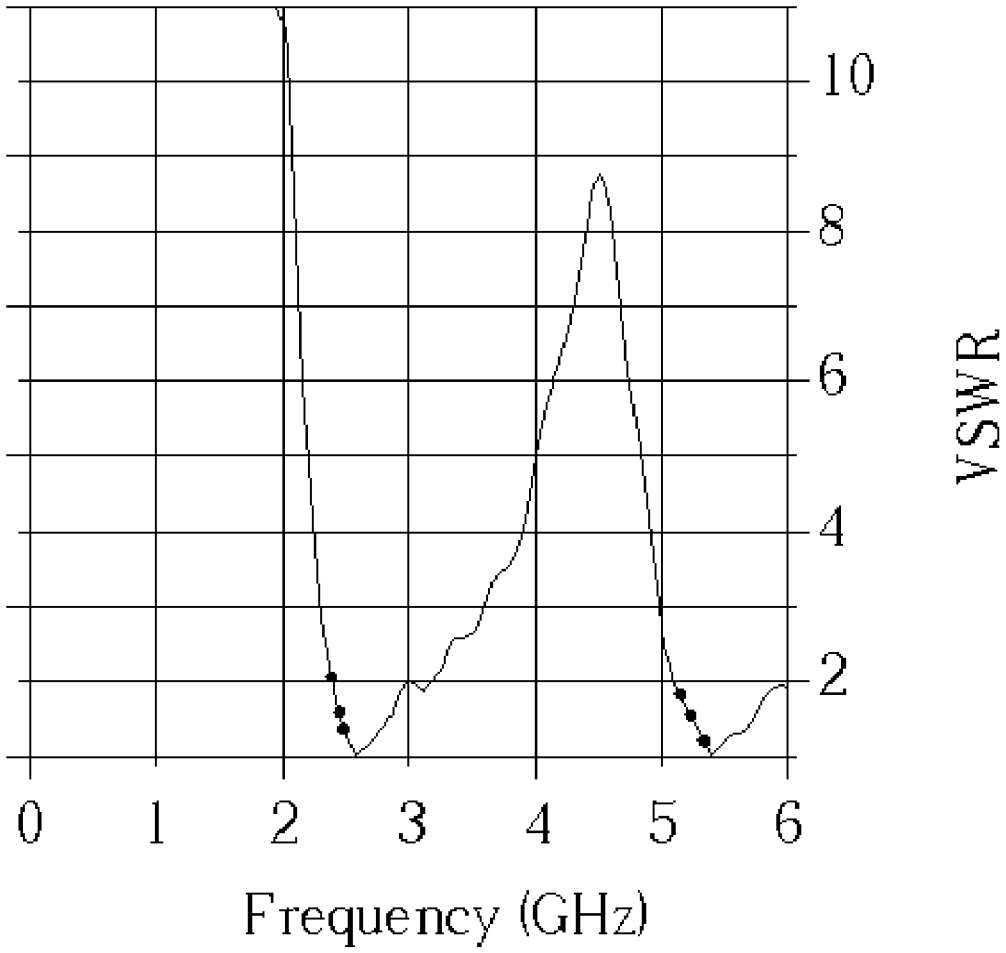
FIG. 6 illustrates the measured VSWR in the preferred embodiment of the present invention.
Figure 8:
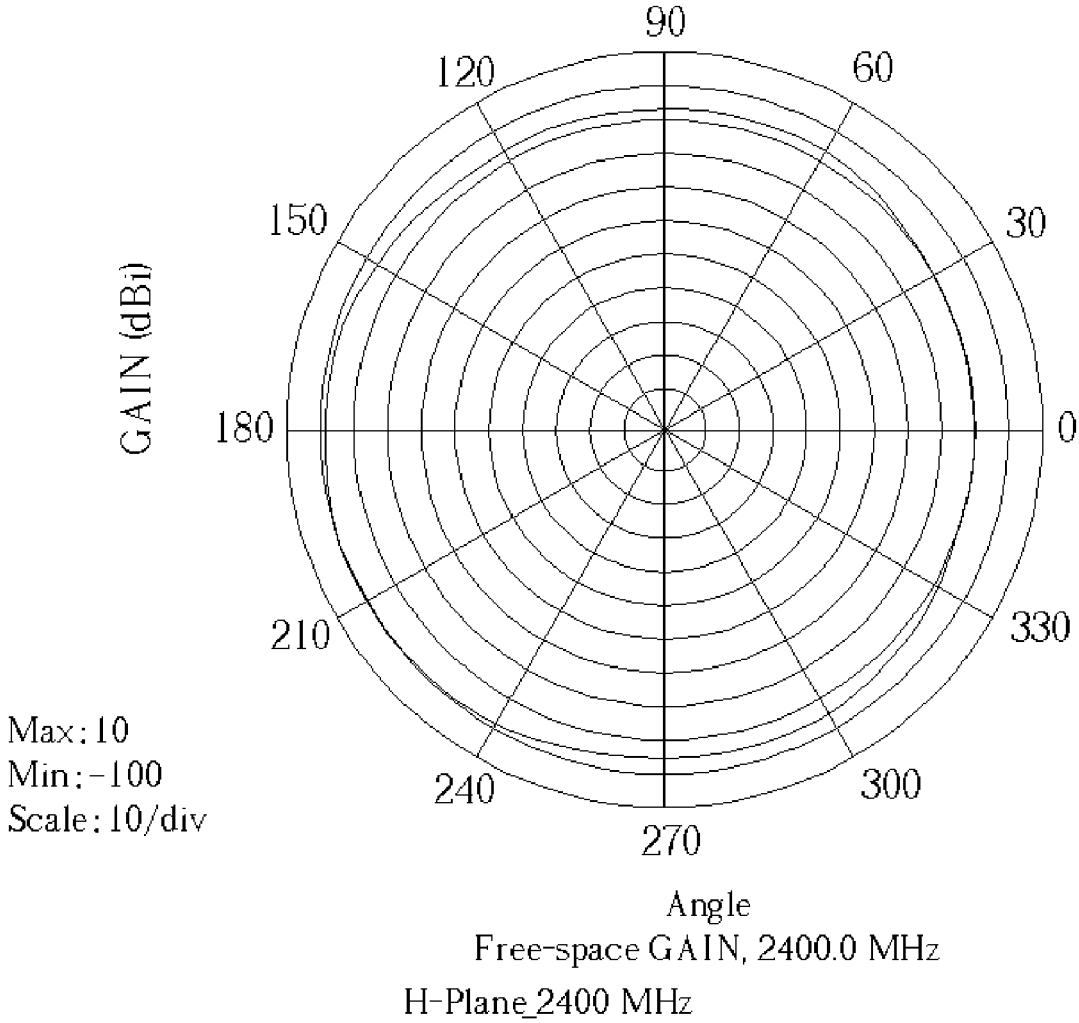
FIG. 8 illustrates the measured radiation pattern in the H-Plane at 2.4 GHz in the preferred embodiment of the present invention.
Figure 9:
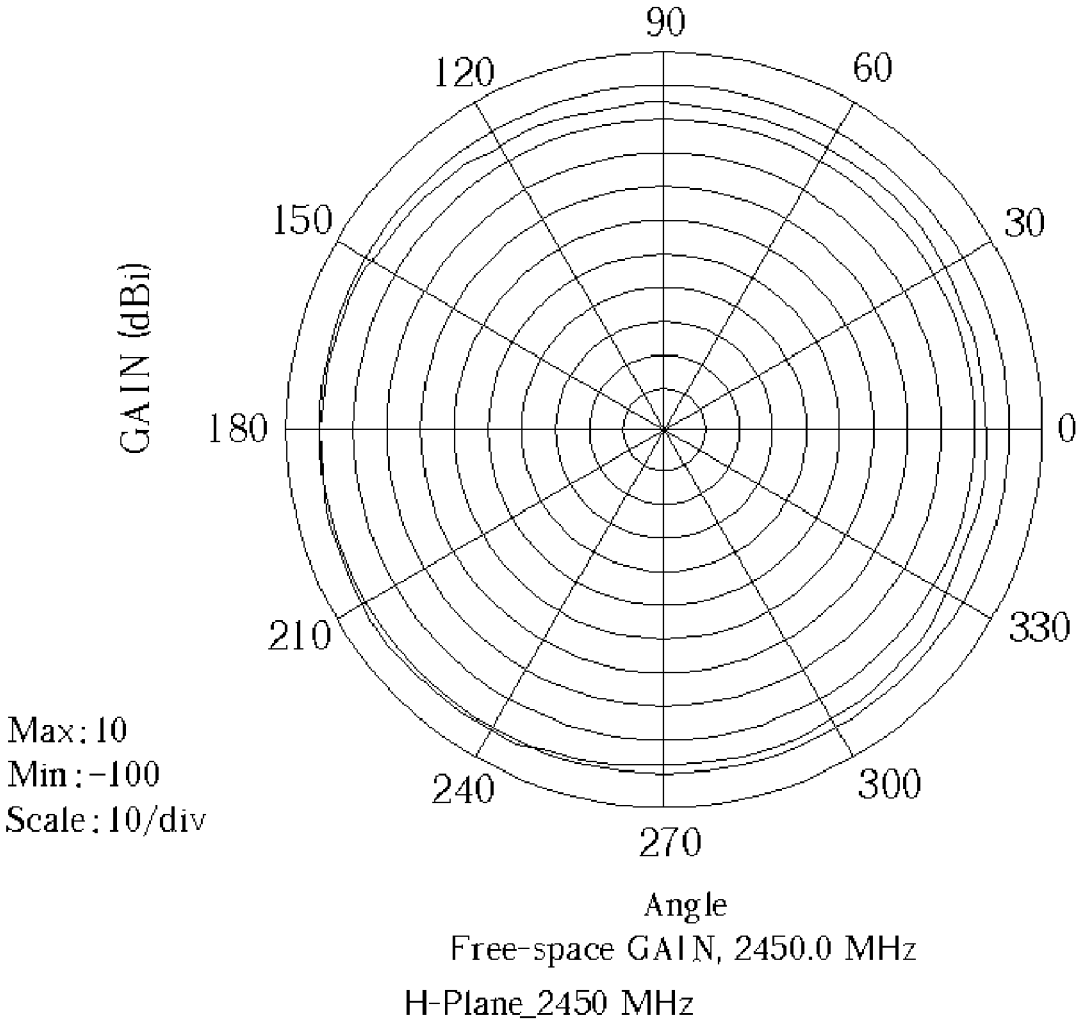
FIG. 9 illustrates the measured radiation pattern in the H-Plane at 2.45 GHz in the preferred embodiment of the present invention.
Figure 10:
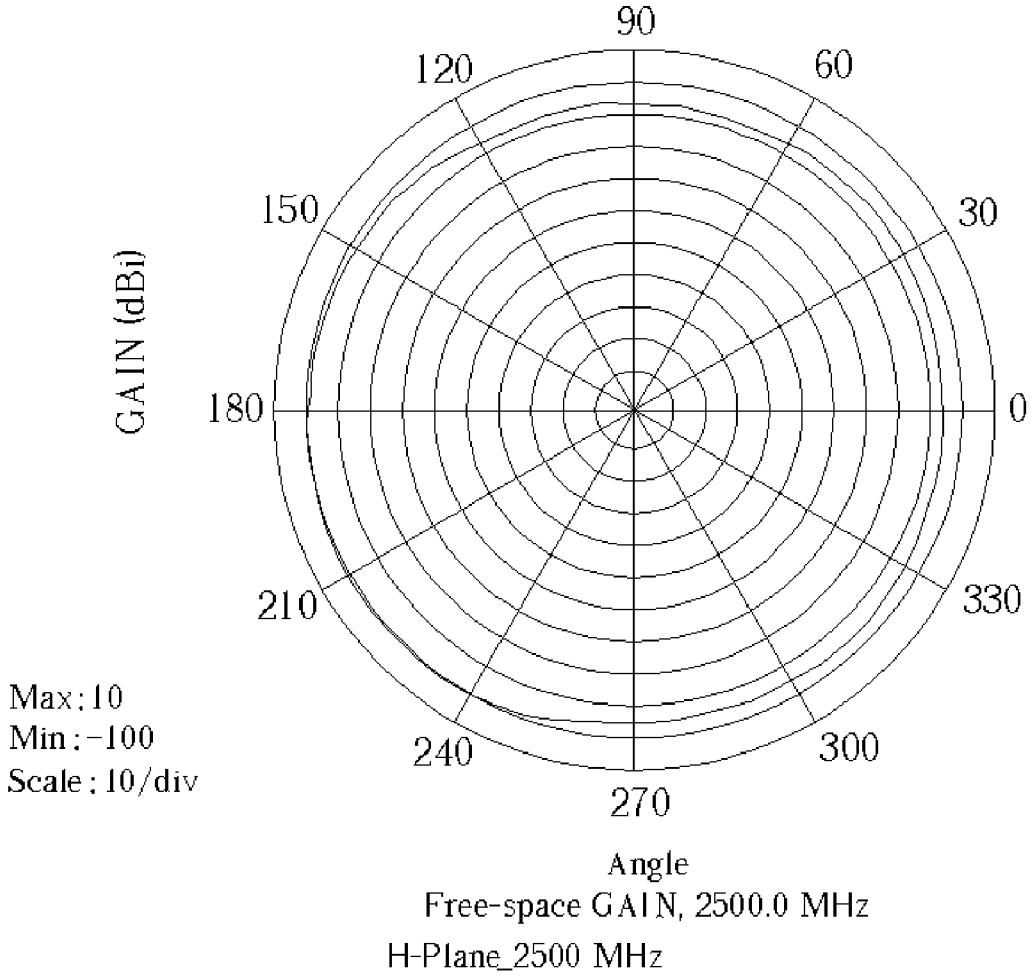
FIG. 10 illustrates the measured radiation pattern in the H-Plane at 2.5 GHz in the preferred embodiment of the present invention.
Figure 11:
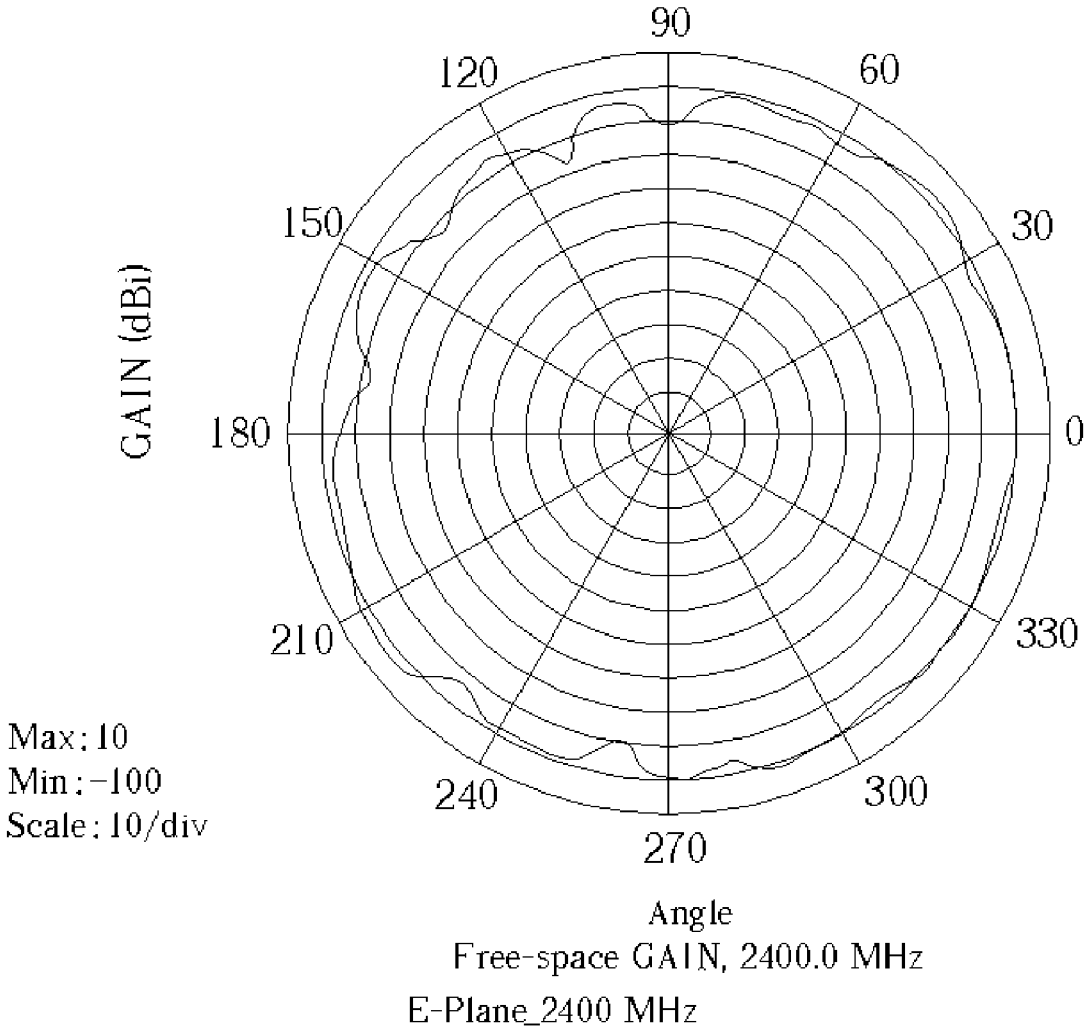
FIG. 11 illustrates the measured radiation pattern in the E-Plane at 2.4 GHz in the preferred embodiment of the present invention.
Figure 12:
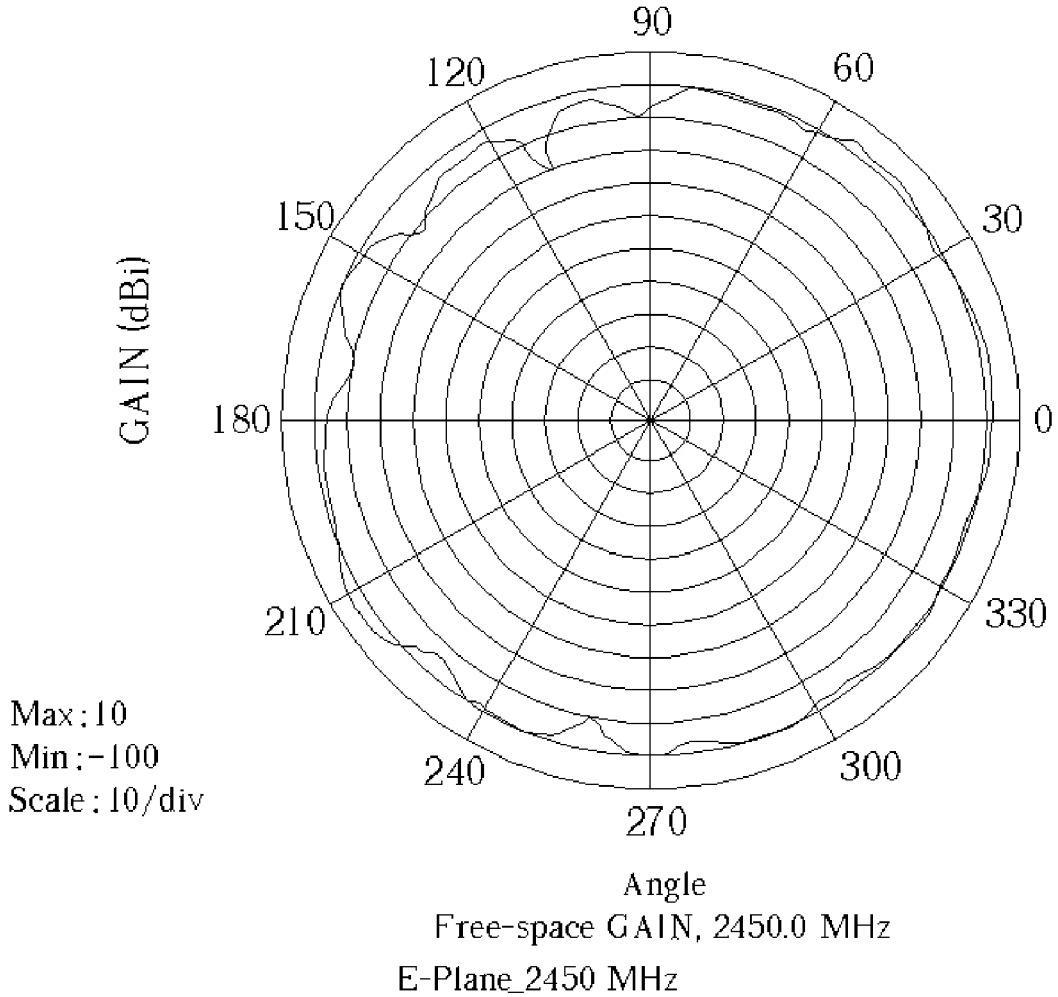
FIG. 12 illustrates the measured radiation pattern in the E-Plane at 2.45 GHz in the preferred embodiment of the present invention.
Figure 13:
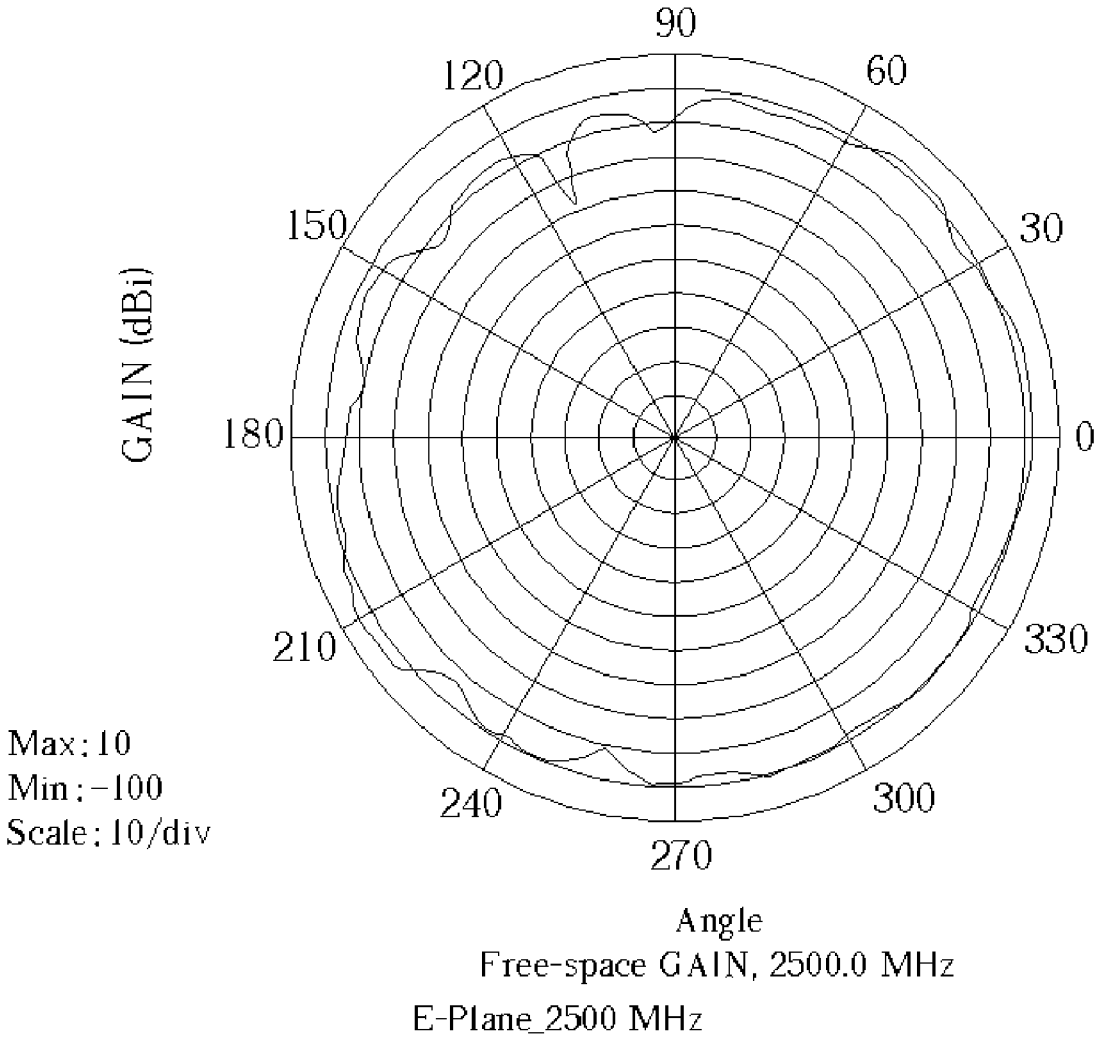
FIG. 13 illustrates the measured radiation pattern in the E-Plane at 2.5 GHz in the preferred embodiment of the present invention.
Figure 14:
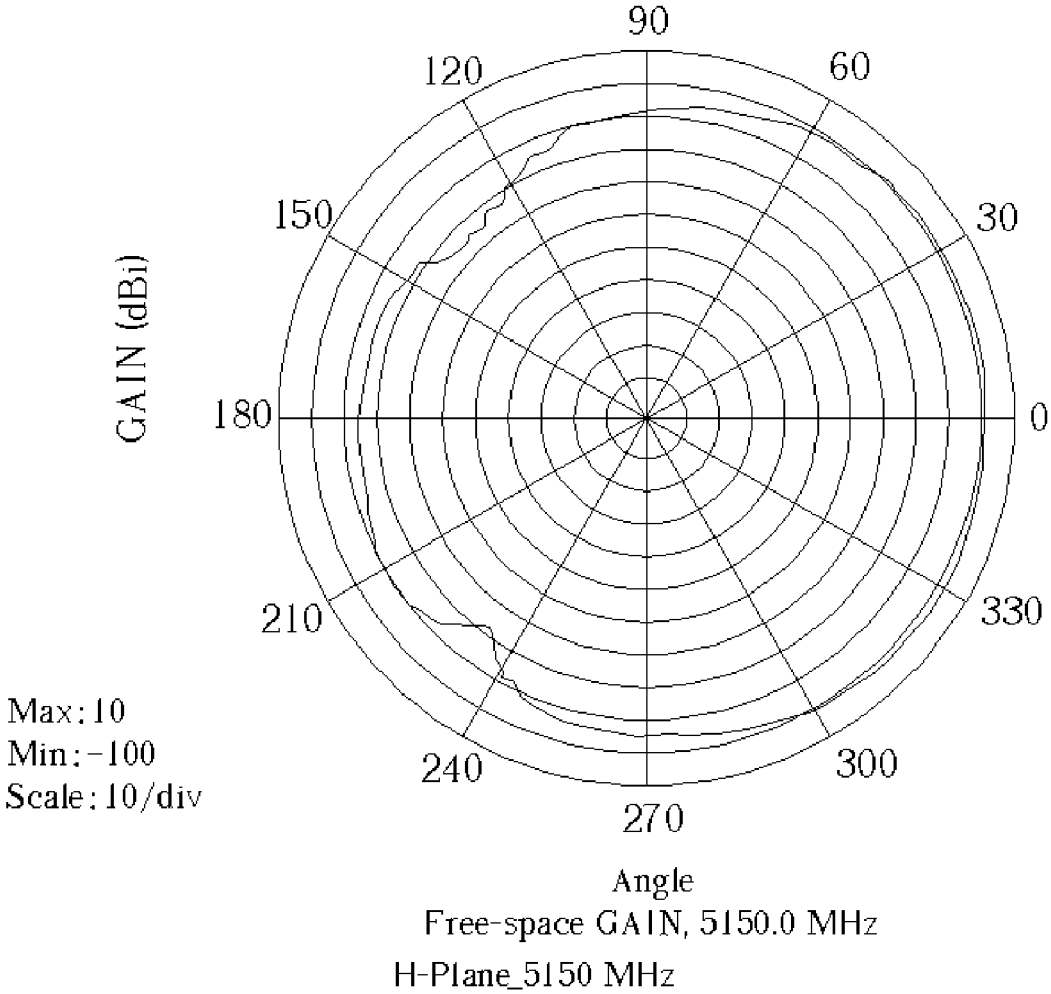
FIG. 14 illustrates the measured radiation pattern in the H-Plane at 5.15 GHz in the preferred embodiment of the present invention.
Figure 15:
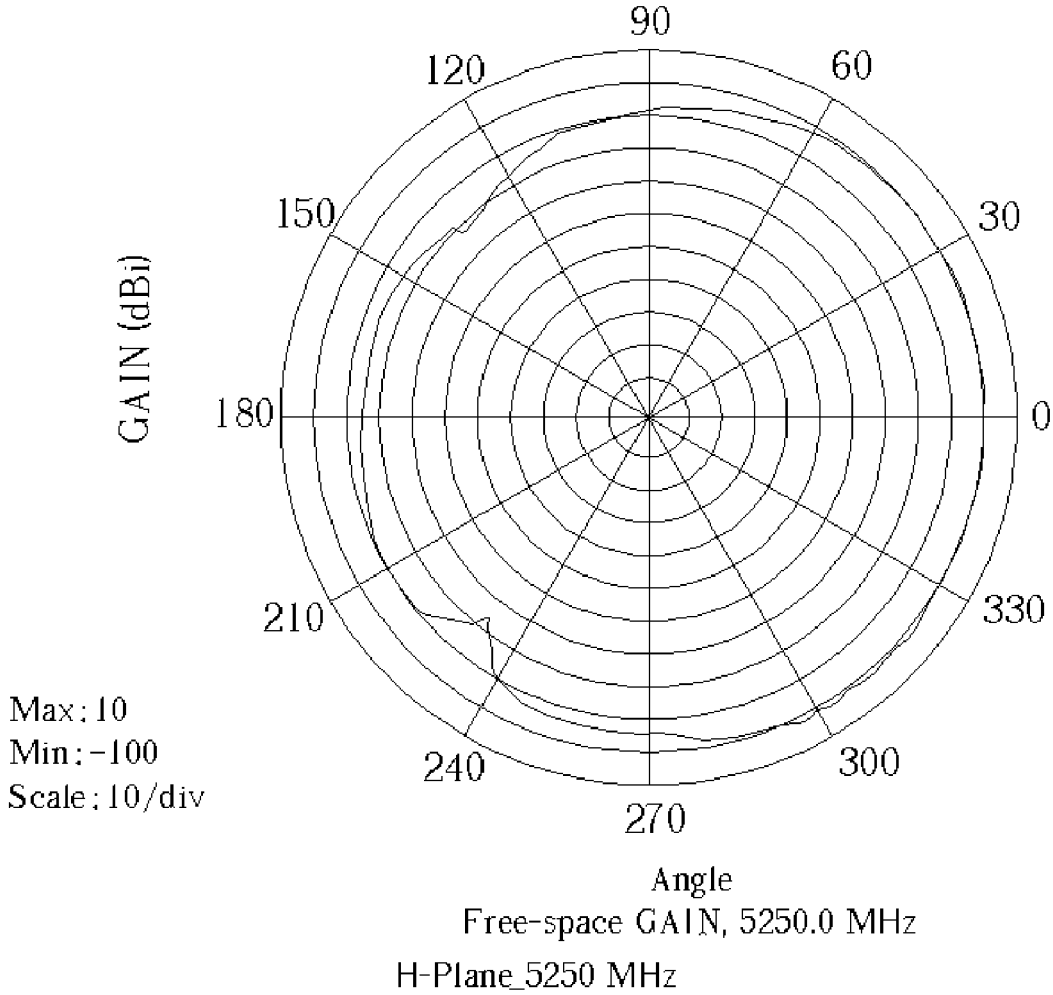
FIG. 15 illustrates the measured radiation pattern in the H-Plane at 5.25 GHz in the preferred embodiment of the present invention.
Figure 16:
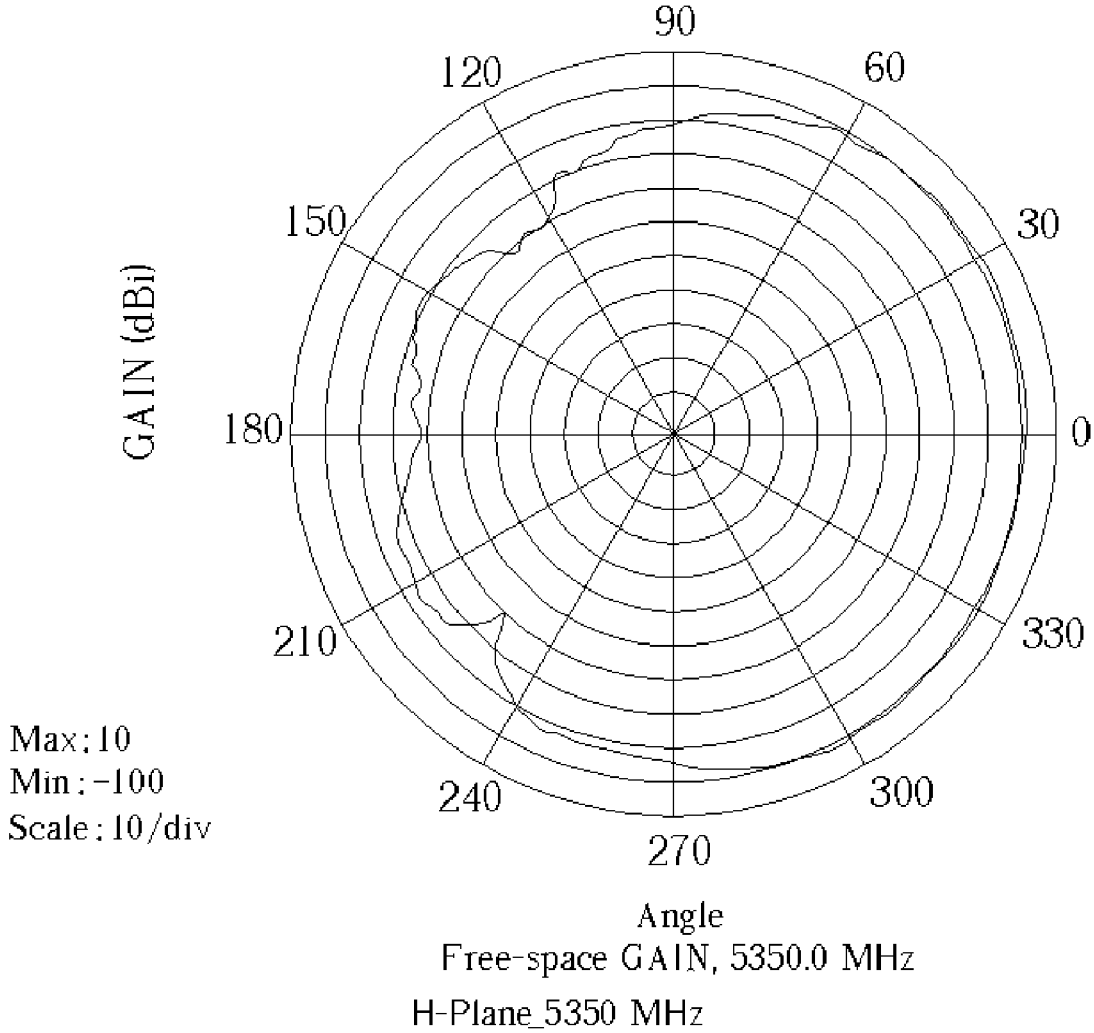
FIG. 16 illustrates the measured radiation pattern in the H-Plane at 5.35 GHz in the preferred embodiment of the present invention.
Figure 17:
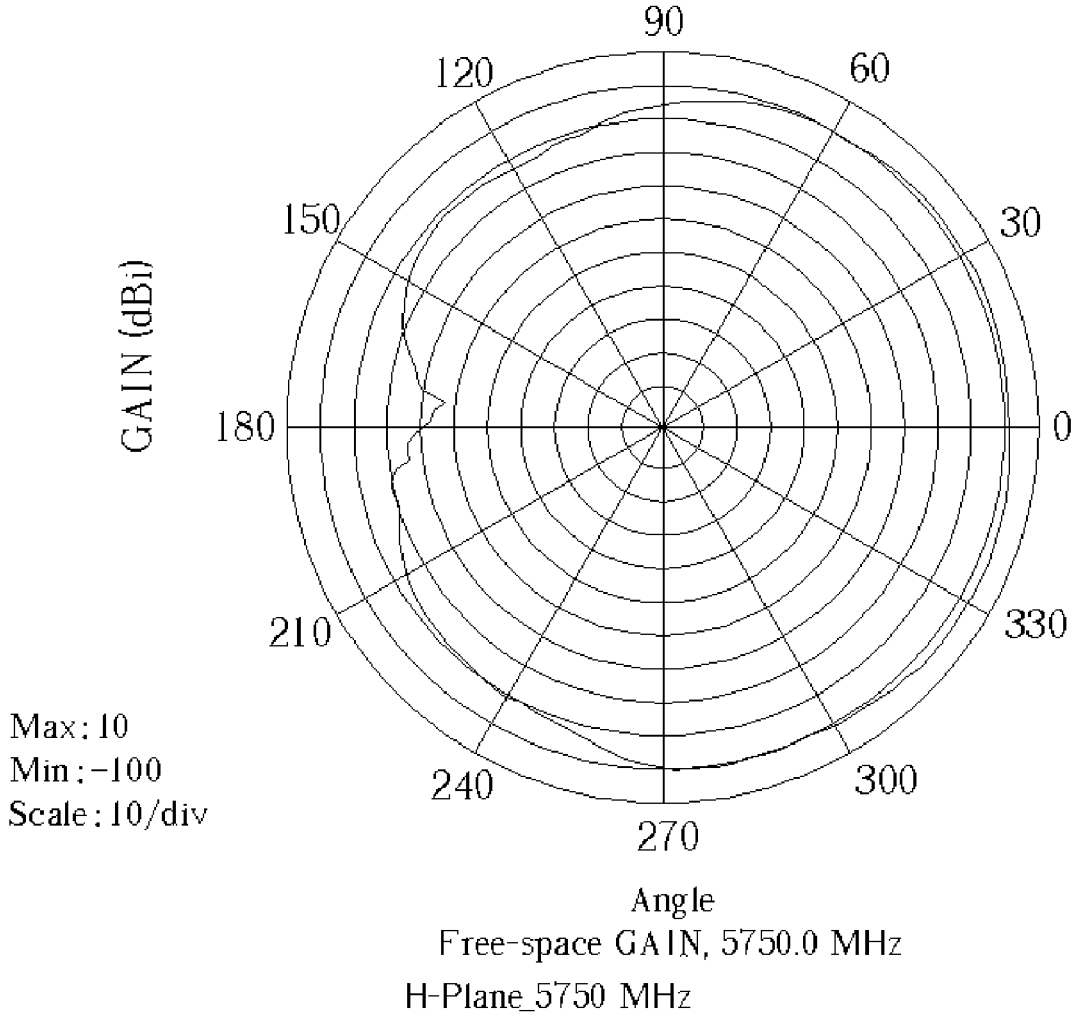
FIG. 17 illustrates the measured radiation pattern in the H-Plane at 5.75 GHz in the preferred embodiment of the present invention.
Figure 18:
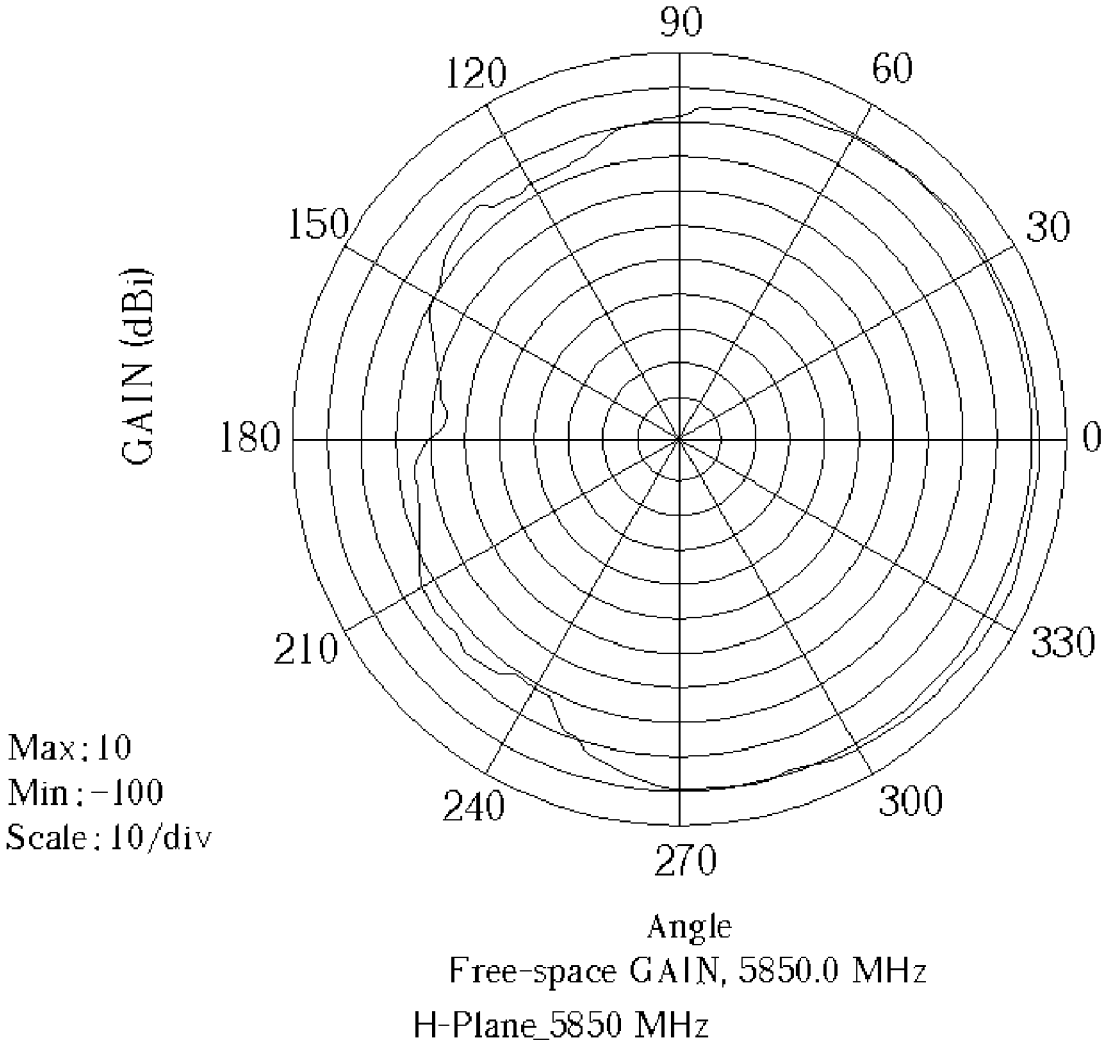
FIG. 18 illustrates the measured radiation pattern in the H-Plane at 5.85 GHz in the preferred embodiment of the present invention.
Figure 19:
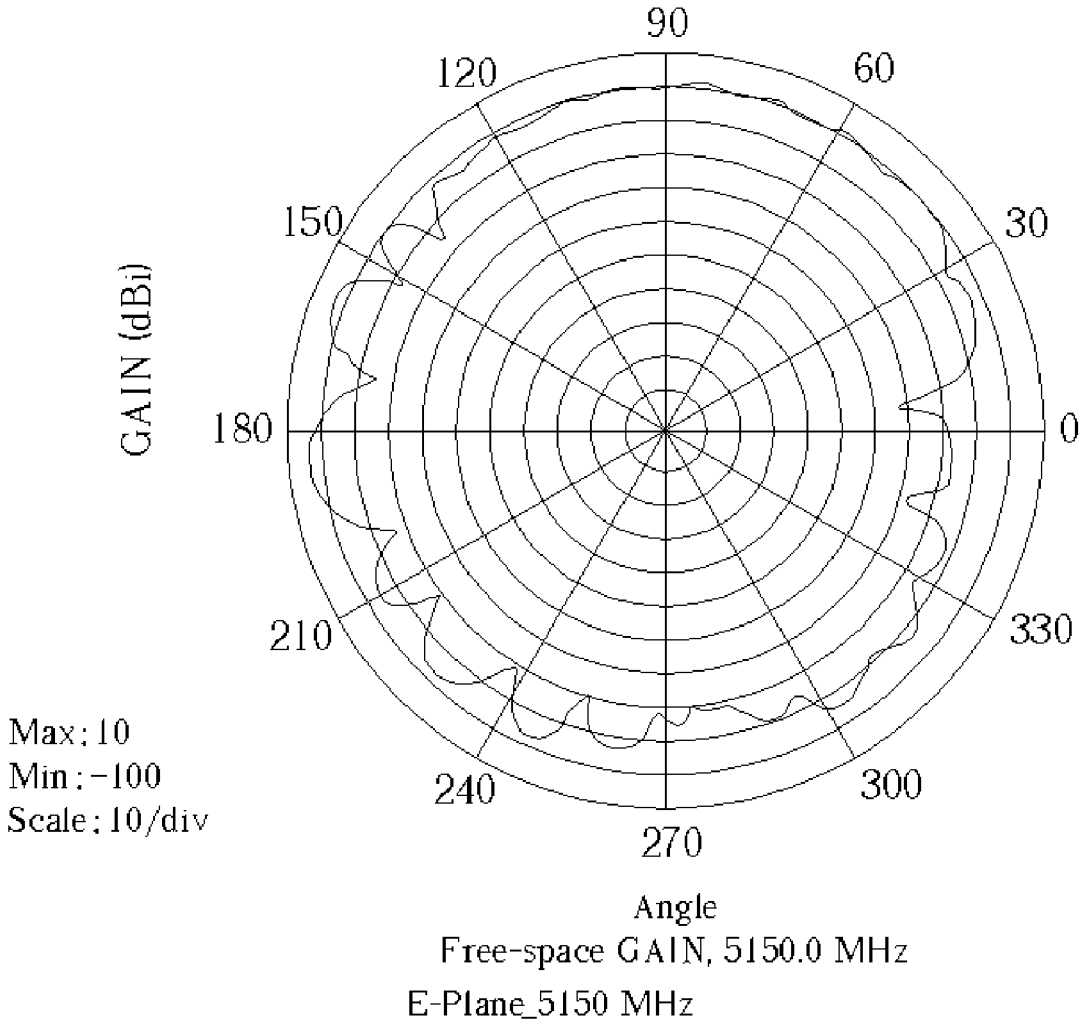
FIG. 19 illustrates the measured radiation pattern in the E-Plane at 5.15 GHz in the preferred embodiment of the present invention.
Figure 20:
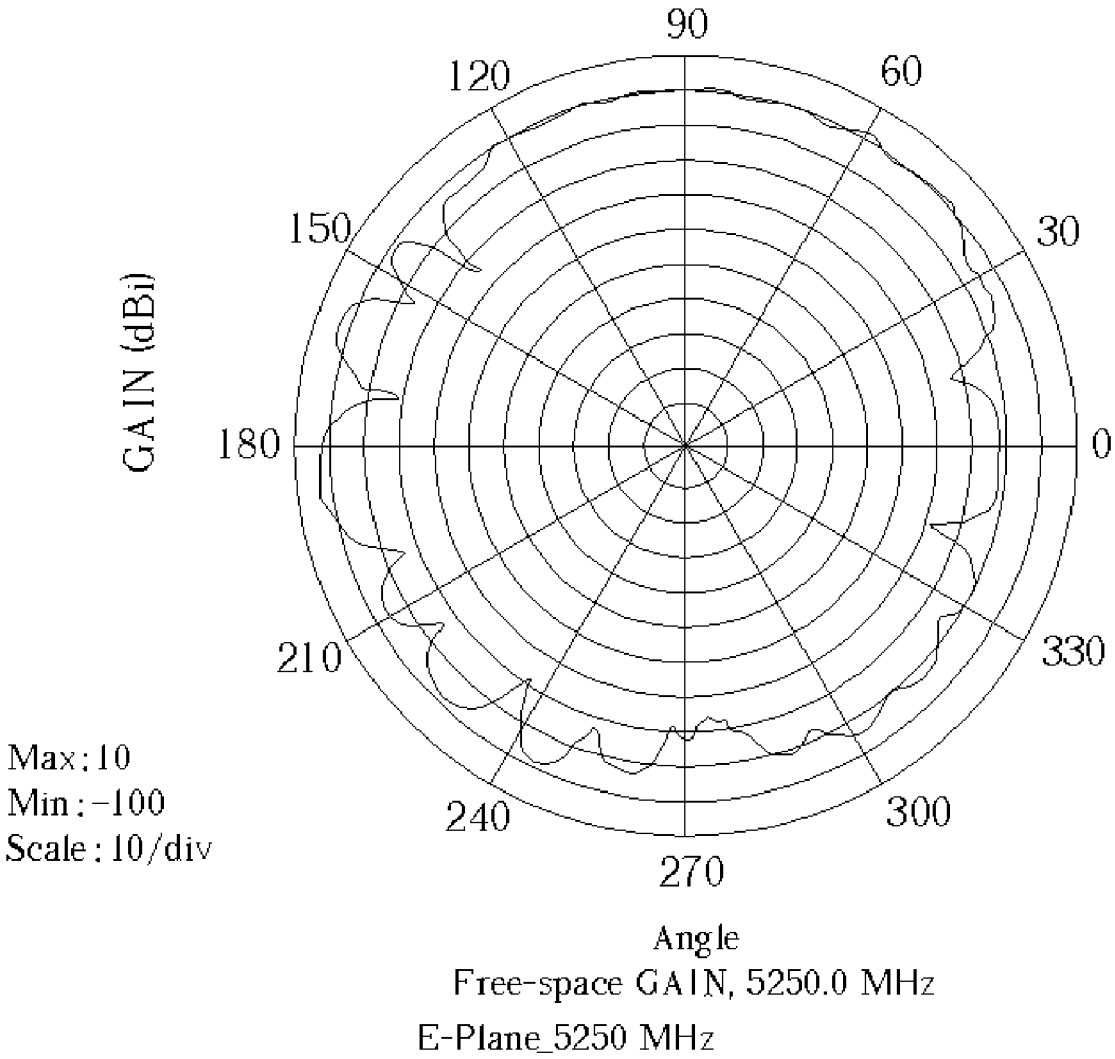
FIG. 20 illustrates the measured radiation pattern in the E-Plane at 5.25 GHz in the preferred embodiment of the present invention.
Figure 21:
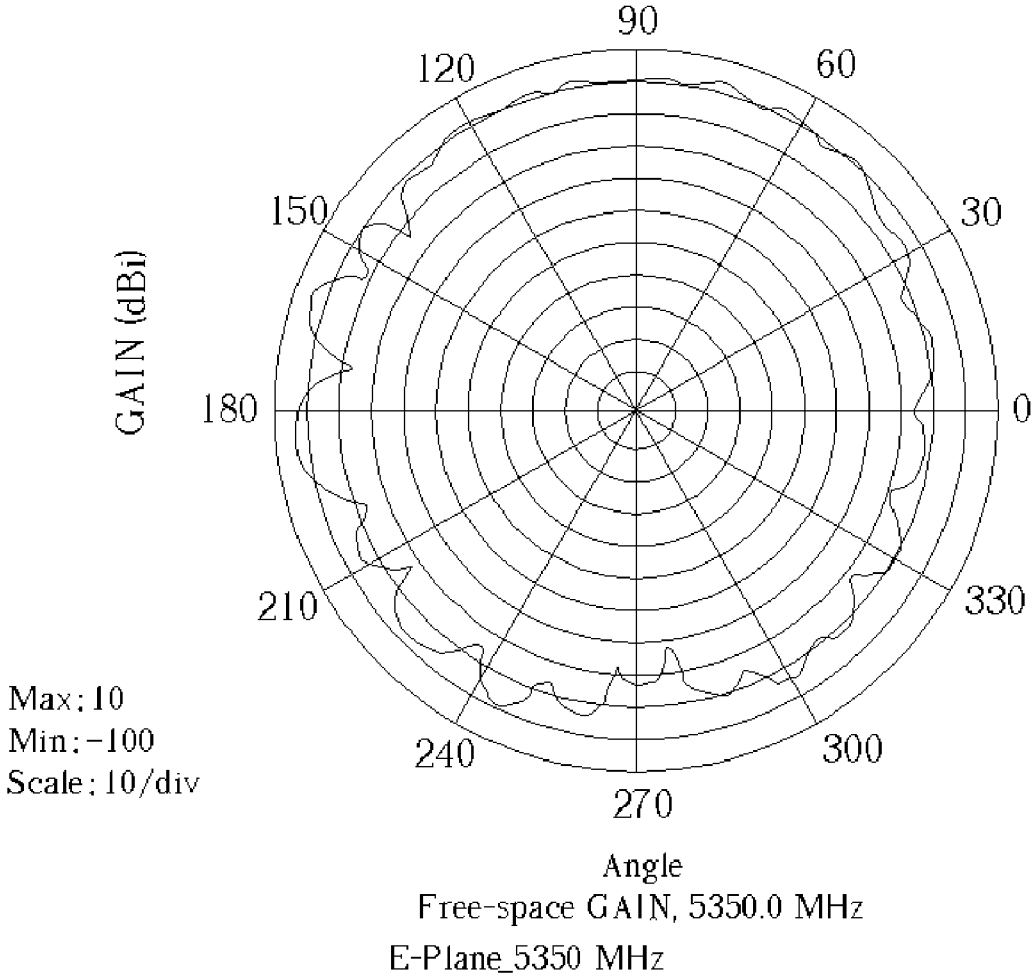
FIG. 21 illustrates the measured radiation pattern in the E-Plane at 5.35 GHz in the preferred embodiment of the present invention.
Figure 22:
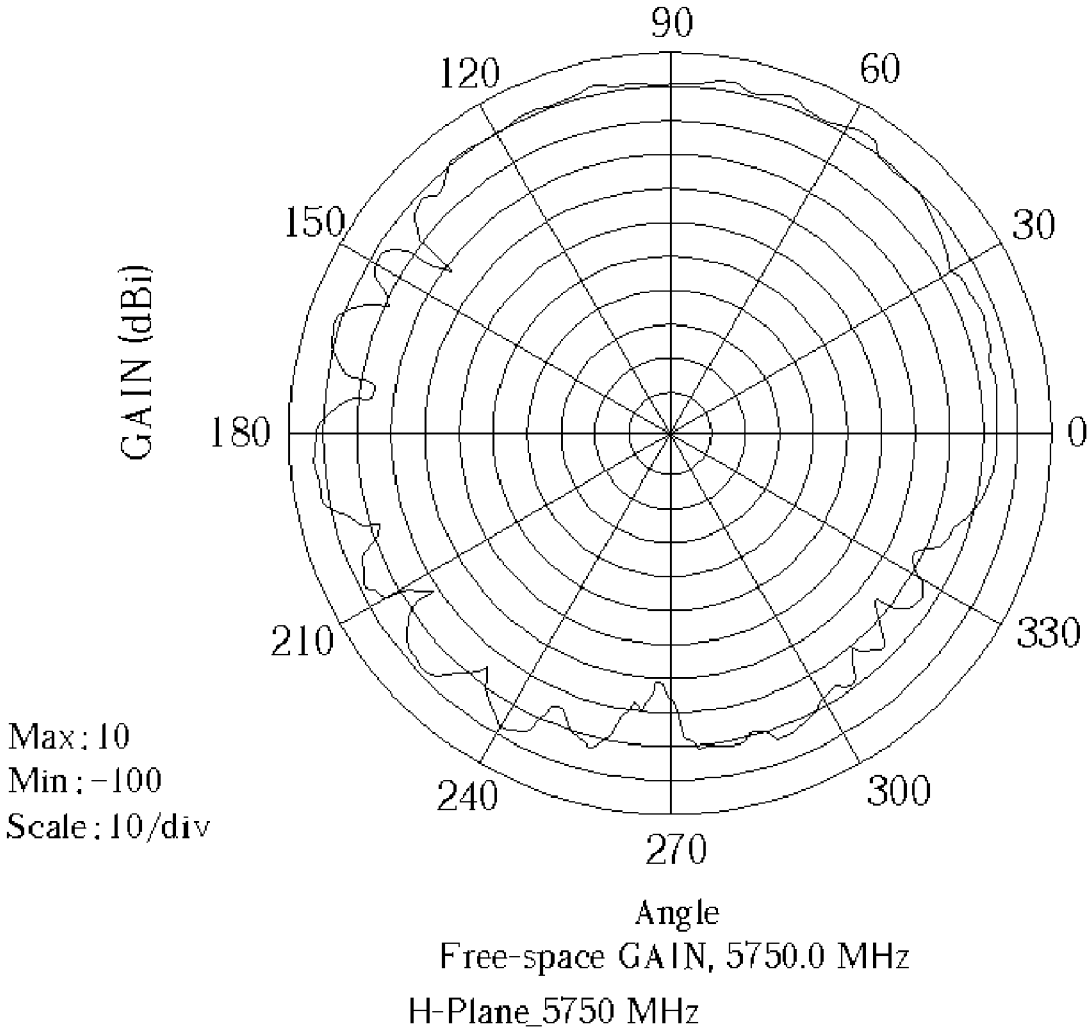
FIG. 22 illustrates the measured radiation pattern in the E-Plane at 5.75 GHz in the preferred embodiment of the present invention.
Figure 23:
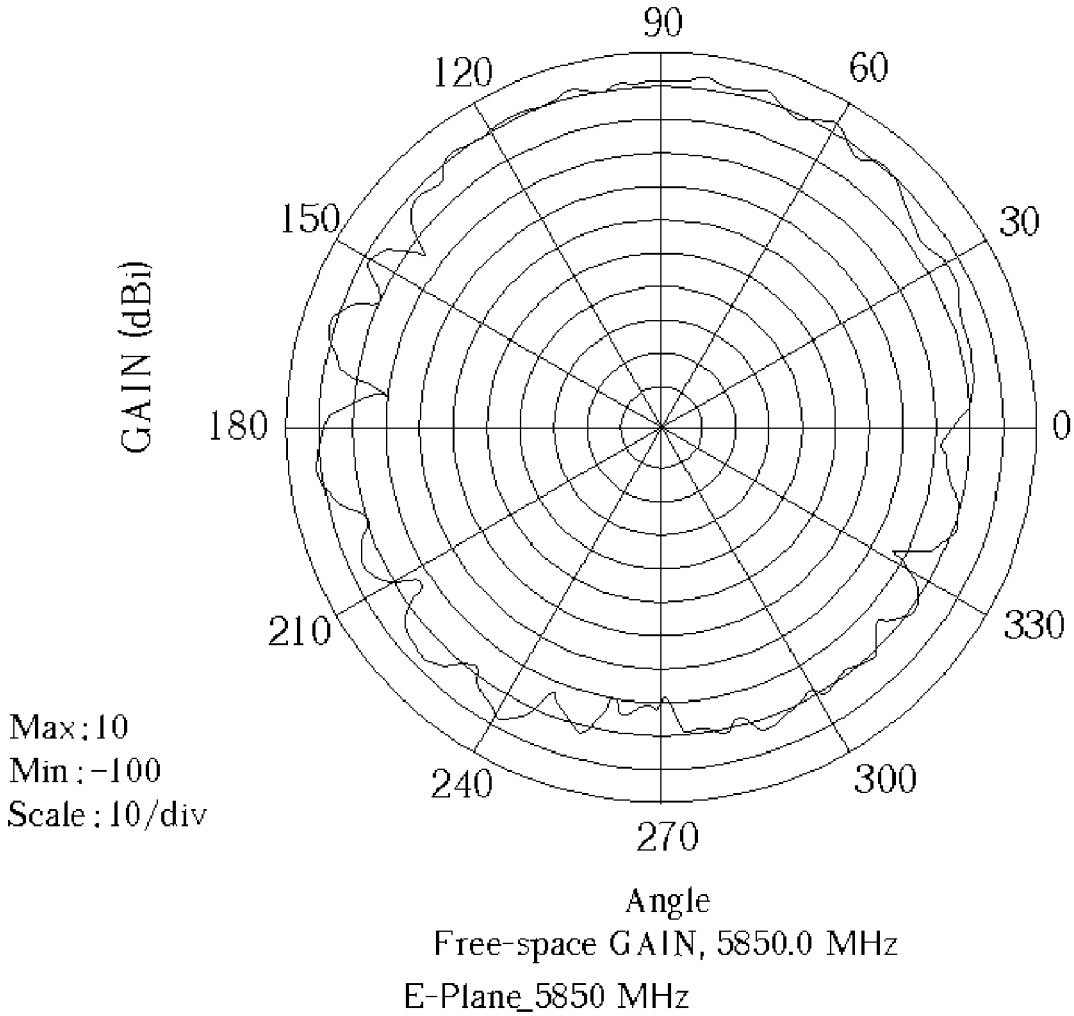
FIG. 23 illustrates the measured radiation pattern in the E-Plane at 5.85 GHz in the preferred embodiment of the present invention.

Please refer to FIGS. 5–23, which are the measurement results of the dual-band antenna. FIG. 5 and FIG. 6 illustrate the reflection coefficient under −10 dB. The low frequency bandwidth in the dual-band antenna 1 is 560 MHz (2410 MHz~2970 MHz), and the high frequency bandwidth in the dual-band antenna 1 is 730 MHz (5100 MHz~5845 MHz). FIGS. 5–23 also disclose the corresponding VSWR(voltage standing wave ratio). From the results, it is found that the operation frequency of the dual-band antenna 1 covers 2.4 GHz (2.4 GHz~2.484 GHz) and 5.2 GHz (5.15 GHz~5.35 GHz), which meet the specification of dual-band WLAN. FIGS. 7–23 illustrate the radiation pattern and gain of the experimental results in the preferred embodiment of the present invention operating at the frequencies of 2.4, 2.45, 2.5 GHz and 5.15, 5.25, 5.35, 5.75, 5.85 GHz. From the preferred embodiment of the present invention, it demonstrates that besides the characteristic of the dual-band operation, it have a characteristic of higher gain when operating at high frequency (5.2 GHz).

In summary, the dual-band antenna 1 of the present invention utilizes the ground pad 14 similar to an "L" shape and the electromagnetic coupling effect generated by the emitting unit 12 to effectively reduce the length of the first wire 121 and the second wire 122 corresponding to the operation frequency. Moreover, because of the special shapes of the first wire 121 and the second wire 122 of the emitting unit 12 and no common part between the first wire 121 and the second wire 122, the first wire 121 and the second wire 122 have a better degree of isolation. It is easier for the designers to adjust each wire independently to change the properties of the antenna, shortening the product lag-time and improving the high frequency gain as well as the bandwidth of the dual-band antenna.

Those skilled in the art will readily observe that numerous modifications and alterations of the device may be made while retaining the teachings of the invention. Accordingly, the above disclosure should be construed as limited only by the metes and bounds of the appended claims.

What is claimed is:

1. A dual-band antenna, comprising:

a substrate having a first surface and a second surface that is on the opposite side of the substrate from the first surface;

a transmission line coupled to a feeding point for transmitting RF signals;

an emitting unit having a first wire and a second wire that are both disposed on the first surface, the first wire and the second wire intersecting at the feeding point, the emitting unit being disposed at a first edge of the substrate; and a ground pad disposed on the second surface of the substrate, wherein the ground pad comprises a base extending from a second edge of the substrate toward the feeding point, the first and second edges being located at opposite sides of the substrate.

2. The dual-band antenna of claim 1 wherein the transmission line is a microstrip.

3. The dual-band antenna of claim 1 wherein the transmission line is a coplanar waveguide.

4. The dual-band antenna of claim 1 wherein the transmission line is a coaxial cable.

5. The dual-band antenna of claim 1 wherein the base of the ground pad is substantially rectangular.

6. The dual-band antenna of claim 1 wherein the ground pad further comprises an extension disposed on the second surface and extending from the base toward the first edge of the substrate.

7. The dual-band antenna of claim 6 wherein the extension is adjacent to the emitting unit.

8. The dual-band antenna of claim 6 wherein the extension of the ground pad is substantially rectangular in shape.

9. The dual-band antenna of claim 6 wherein the combination of the base and the extension forms an "L" shape.

10. The dual-band antenna of claim 1 wherein the first wire decides the low operation frequency of the dual-band antenna.

11. The dual-band antenna of claim 1 wherein the second wire is shorter than the first wire and decides the high operation frequency of the dual-band antenna.

12. The dual-band antenna of claim 1 wherein the second wire is extended upward from the feeding point and bent at some angle, being parallel to one side of the base.

13. The dual-band antenna of claim 1 wherein the first wire is extended upward from the feeding point and bent at some angle, being parallel to one side of the base.

14. The dual-band antenna of claim 1 wherein the characteristic impedance of the transmission line is 50 Ohms.

* * * * *